US007239274B2

(12) United States Patent
Lee et al.

(10) Patent No.: US 7,239,274 B2
(45) **Date of Patent: *Jul. 3, 2007**

(54) DYNAMIC ORIENTATION ADJUSTING DEVICE AND METHOD FOR SATELLITE ANTENNA INSTALLED IN MOVEABLE CARRIER

(75) Inventors: Chien-Chung Lee, Dasi Township, Taoyuan County (TW); Juyang Chang, Dali (TW)

(73) Assignee: Mitac Technology Corp., Hsin-Chu Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/315,491

(22) Filed: Dec. 23, 2005

(65) Prior Publication Data

US 2006/0187117 A1 Aug. 24, 2006

Related U.S. Application Data

(63) Continuation-in-part of application No. 11/062,871, filed on Feb. 23, 2005, now Pat. No. 7,012,566.

(51) Int. Cl.
*H01Q 3/00* (2006.01)

(52) U.S. Cl. ..... 342/359

(58) Field of Classification Search ..... 342/75, 342/359, 422; 343/754, 757

See application file for complete search history.

(56) References Cited

U.S. PATENT DOCUMENTS

| | | | | |
|---|---|---|---|---|
| 4,823,134 | A * | 4/1989 | James et al. | 342/359 |
| 5,854,609 | A * | 12/1998 | Pyo et al. | 342/359 |
| 6,972,724 | B1 * | 12/2005 | Tian et al. | 343/711 |
| 7,012,566 | B2 * | 3/2006 | Lee et al. | 342/359 |

FOREIGN PATENT DOCUMENTS

| | | |
|---|---|---|
| JP | 2000-068877 | 3/2000 |
| JP | 2004-080501 | 3/2004 |

* cited by examiner

*Primary Examiner*—Dao Phan
(74) *Attorney, Agent, or Firm*—Rosenberg, Klein & Lee

(57) ABSTRACT

Disclosed is a device and method for dynamically adjusting orientation of a satellite antenna carried in a movable carrier, including a satellite tracking system and an adjusting device. The satellite tracking system includes a position processor that receives a group of positioning signals comprising a current coordinate from a group of GPS satellites and retrieve a program signal comprised a preset coordinate among at least one of program satellites, a comparator comparing the current coordinate with a preset coordinate to generate an deviation, and a microprocessor processing the deviation to issue a control signal that is fed to the adjusting device for changing orientation of the antenna to match with that of the program satellite.

13 Claims, 3 Drawing Sheets

DYNAMIC ORIENTATION ADJUSTING DEVICE AND METHOD FOR SATELLITE ANTENNA INSTALLED IN MOVEABLE CARRIER

REFERENCE TO RELATED APPLICATIONS

The present invention is a Continuation-in-Part of patent application Ser. No. 11/062,871, filed Feb. 23, 2005 now U.S. Pat. No. 7,012,566.

FIELD OF THE INVENTION

The present invention relates generally to a control device for adjusting the orientation of a satellite disc antenna, and in particular to a control device that dynamically adjusts the orientation of a satellite disc antenna carried by a moving carrier, such as a vehicle, so as to make the constantly point at program satellites located at predetermined positions.

BACKGROUND OF THE INVENTION

Global positioning system (GPS) is widely used in a variety of applications, such as automobile navigation, geographic survey, satellite television program, satellite broadcasting, satellite communication, and military applications. The general function of the global positioning system is detection of the position, namely coordinates, of an object, which may be moving or maintains fixed, and calculation of distance, time, velocity and altitude of the object. Such data are of importance use in a variety of applications, which means the global positioning system is getting broader applications.

Development of the global positioning system has made a great progress in a number of applications. For example, U.S. Pat. No. 6,680,694 discloses a GPS based vehicle information system, comprising an in-vehicle system that communicates with a centralized server system via a wireless communication link. A user may specify a destination to the in-vehicle system, which transmits the specification of the destination to the centralized server system. The server system computes a route to the destination and transmits the computed route back to the in-vehicle system. The in-vehicle system may then guide the user to drive along the route.

Another example is illustrated in U.S. Pat. No. 6,690,323, which discloses a GPS receiver having emergency communication channel. When a normal GPS communication channel is interfered with, the communication of the GPS receiver can be maintained by switching to the emergency channel.

A further example is U.S. Pat. No. 6,633,814, which discloses a GPS system for navigating a vehicle, comprising vehicle carried receiver that receives a GPS signal to perform vehicle navigation based on pre-established maps and route information.

One further example is shown in U.S. Pat. No. 6,671,587, which discloses a vehicle dynamic measuring apparatus and a method using multiple GPS antennas. To realize vehicle dynamic measurement and determination of velocity, two GPS receiving antennas are installed in a vehicle and a controller is employed to detect change in carrier frequency.

When people watch TV programs or listen to radio programs in a moving vehicle, the electromagnetic waves that carry the programs are received by a frequency based receiver carried in the vehicle. In other words, the program can be correctly received once the receiver in tuned to the frequency of the electromagnetic waves that carry the program. Since the electromagnetic waves are generally omnidirectional, an antenna can receives the waves without being set in a specific direction.

However, an electromagnetic signal that carries a satellite program is directional, which can be received by an antenna oriented in a particular direction. This makes it difficult to receive the satellite program in a moving vehicle for the direction is constantly changed. Thus, generally speaking, a conventional satellite program receiving device that is generally designed for use on fixed location cannot effectively and clearly receive the satellite program in a moving vehicle.

Past development of the GPS techniques, such as those discussed above, does not provide a solution for clearly receiving satellite program in a moving vehicle. The present invention is thus aimed to provide a solution for such a problem.

SUMMARY OF THE INVENTION

An objective of the present invention is to provide a dynamic adjustment control device for a satellite antenna carried in a moving carrier, which tracks the current position of at least one program satellite with respect to the carrier, determines an deviation of the position of the satellite due to the movement of the carrier, and adjusting, based on the deviation, the orientation of the antenna to clearly receive program signals from the program satellite.

To realize the objective, the present invention provides a device that is capable of dynamic adjustment of the orientation of an antenna carried by a moving vehicle to obtain an optimum reception of satellite programs. The control device comprises a satellite coordinate tracking device and an antenna adjusting mechanism. The satellite coordinate tracking device comprises a GPS position processor, which processes a positioning signal received from a group of GPS satellites to obtain current coordinate of the movable carrier currently with respect to the program satellite and compares the current satellite coordinate with a preset coordinate of the program satellite that is retrieved from a preset coordinate register. A deviation signal is generated, if the current coordinate is different from the preset one. The deviation signal is fed to a microprocessor, which provides a correction signal corresponding to the deviation signal. The correction signal is fed to an adjusting mechanism to reorient the antenna to match the preset coordinate of the program satellite.

Three partial preset coordinates of the preset coordinate of the a program satellite, including preset longitude, preset latitude, and preset altitude of a program satellite, are used to adjust the antenna with respect to the program satellite. The dynamic adjusting device of the present invention allows for adjustment of the orientation of the antenna that is carried in a moving vehicle with a current coordinate including three partial preset coordinates, i.e., current longitude, current latitude and current altitude, with respect to the program satellite to match the preset longitude, preset latitude, and preset altitude of the preset coordinate of the program satellite, which in turn realizes an optimum reception of program signals sent from the program satellite by an program receiver within the moving vehicle and makes display of the programs clearer carried by the program signals, regardless the moving of the vehicle.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENTS

Figure 1:
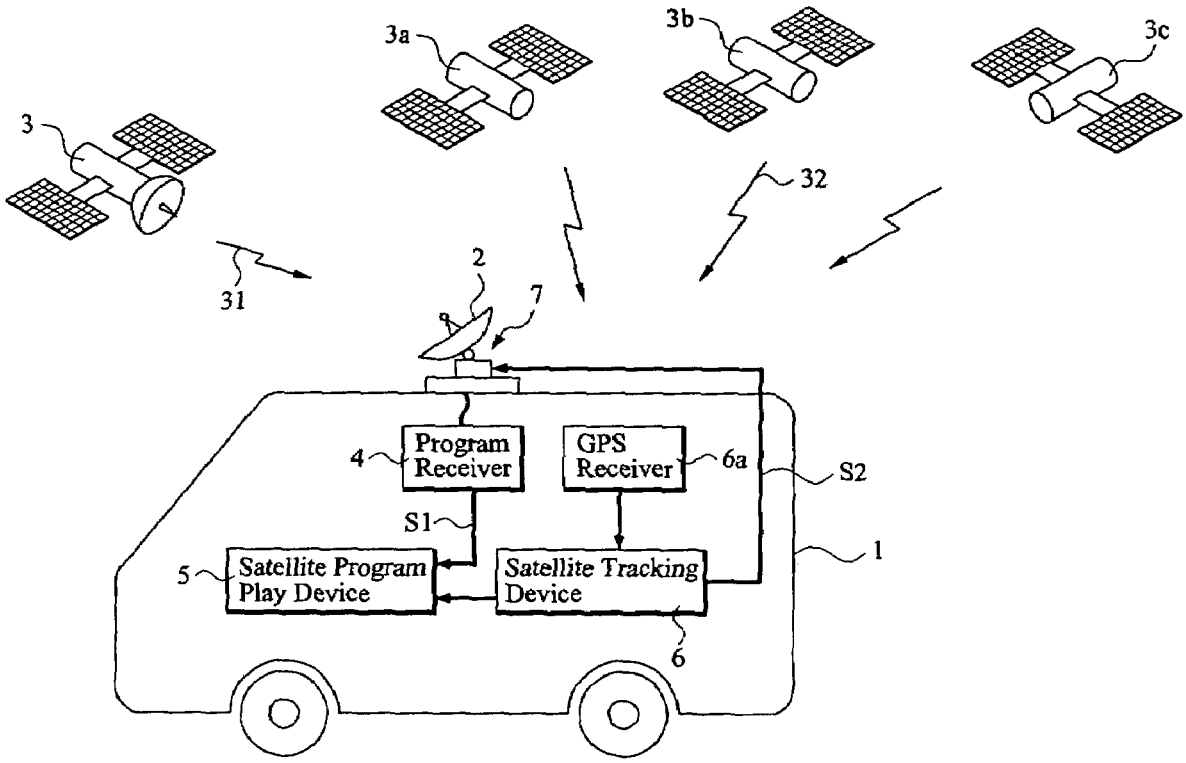
FIG. 1 is a schematic view illustrating a dynamic adjusting device for satellite antenna carried in a vehicle in accordance with the present invention.

With reference to the drawings and in particular to FIG. 1, a dynamic adjustment control device constructed in accordance with the present invention is shown, which is provided for controlling the adjustment of orientation of a satellite antenna, generally designated with reference numeral 2, mounted in/on a movable carrier, such as a moving vehicle 1. A program satellite 3 located in a predetermined position with a preset coordinate sends a program signal 31 which can be received by a program receiver 4 via a satellite disc antenna 2. A number of GPS satellites 3*a*, 3*b*, 3*c* that are located at differently predetermined positions send a series of positioning signals 32 which can be received by a GPS receiver 6*a*. The program receiver 4 and the GPS receiver 6*a* are installed in the vehicle 1. The program signals 31 sent from the program satellite 3 carry audio/video programs that can be displayed on for example a TV set or can be broadcast through a radio or the likes.

The program signal 31 sent from the program satellite 3 is received by the program receiver 4 via the antenna 2 and the receiver 4 generates a satellite program signal S1 corresponding to the received program signal 31. The satellite program signal S1 generated by the program receiver 4 is comprised of a video component, and an audio component, all obtained by processing the program signal 31. The satellite program signal S1 is fed to a satellite program play device 5, which may then play a satellite program composed of the video and audio components.

In a preferred embodiment of the present invention, a satellite tracking device 6 is provided in the vehicle 1 and electrically coupled to the GPS receiver 6*a* to receive the positioning signals 32 and also electrically coupled to an antenna adjusting device 7, which receives a control signal from the satellite tracking device for adjusting the orientation of the antenna 2 in order to dynamically track the program satellite 3 and cooperates with an antenna adjustment mechanism 7 and thus realizing the best reception of the program signal 31 from the satellite 3 by the antenna 2.

Figure 2:
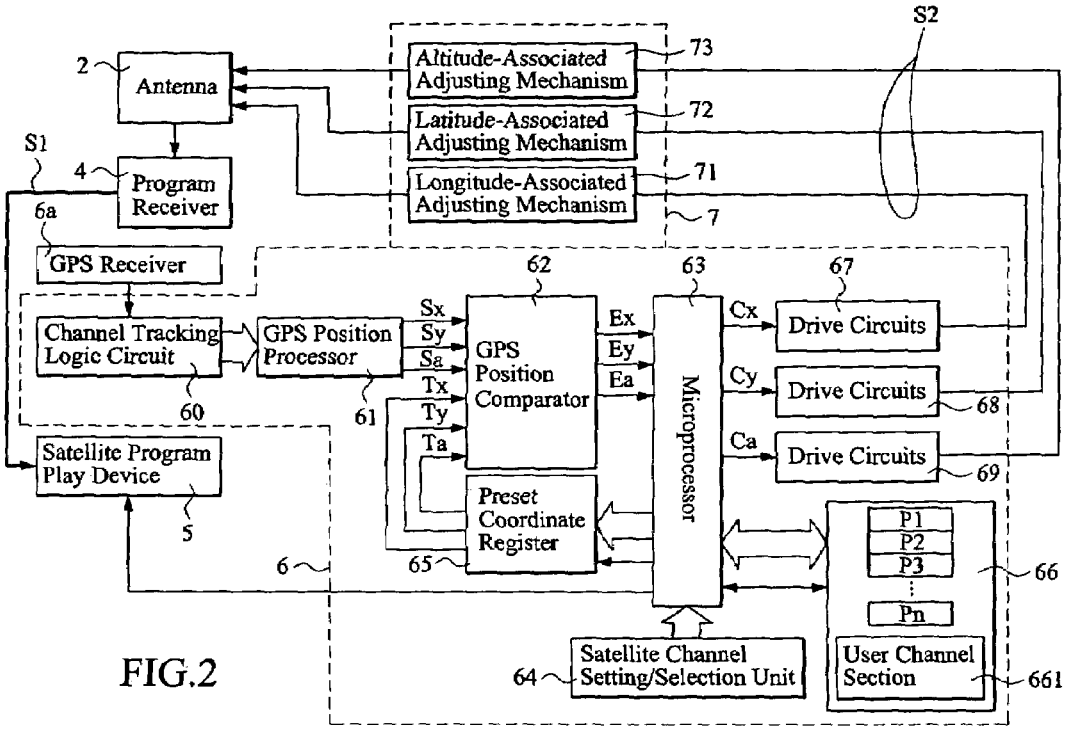
FIG. 2 is a block diagram of a control circuit of the dynamic adjusting device in accordance with the present invention.

Also referring to FIG. 2, a circuit of the control device in accordance with the present invention is shown. The satellite tracking device 6 comprises a channel tracking logic circuit 60, which receives the positioning signal 32 from the GPS receiver 6*a* and in turn provides a signal to a GPS position processor 61 in which the current coordinate is retrieved from the positioning signal 32 and processed to provide a current coordinate of the vehicle 1. The current coordinate in this embodiment comprises a current longitude Sx, a current latitude component Sy, and a current altitude Sa.

The current longitude Sx, current latitude Sy, and current altitude Sa are then fed to a first set of inputs of a GPS position comparator 62. The GPS position comparator 62 has a second set of inputs that receive preset longitude Tx, preset latitude Ty, and preset altitude Ta from a preset coordinate register 65. The preset longitude Tx, preset latitude Ty, and preset altitude Ta are stored in the preset coordinate register 65 and are preset by a user in advance via a satellite channel setting/selection unit 64. The user may select a favorite channel received from the program satellite 3 via the satellite channel setting/selection unit 64, which provides and stores the associated preset longitude Tx, preset latitude Ty, and preset altitude Ta in the register 65.

In addition, a number of satellite program channels P1, P2, P3, . . . , Pn may be preset in a channel memory 66 in the factory site when the device is manufactured or later by a user. This allows the user to readily select one of the program channels P1–Pn from the channel memory 66 via the satellite channel setting/selection unit 64. Preset longitude Tx, preset latitude Ty, and preset altitude Ta associated with the selected channel P1–Pn can be retrieved from data stored in the channel memory 66 or obtained by processing the data from the channel memory 66. Such longitude, latitude, and altitude are then transferred to the preset coordinate register 65 from which the preset longitude Tx, preset latitude Ty, and preset altitude Ta are conveyed to the GPS position comparator 62.

The memory 66 selectively comprises a user channel section 661 in which a user's personal favorite channel can be set and stored by the user via the satellite channel setting/selection unit 64. Date stored in the user channel section 661 of the memory 66 may be quickly retrieved by the user and processed and transferred to the preset coordinate register 65.

The GPS position comparator 62 performs a comparison between the current longitude Sx, current latitude Sy, and current altitude components Sa received from the GPS satellites 3*a*, 3*b*, 3*c* and the preset longitude Ta, preset latitude Ty, and preset altitude Ta received from the preset coordinate register 65 and generates a longitude deviation signal Ex, a latitude deviation signal Ey, and an altitude deviation signal Ea, which are fed to a microprocessor 63. Based on the longitude deviation signal Ex, latitude deviation signal Ey and altitude deviation signal Ea, a set of correct control signals S2 comprising a longitude correction control signal Cx, a latitude correction control signal Cy, and an altitude correction control signal Ca are calculated by the microprocessor 63 and respectively applied to first, second, and third drive circuits 67, 68 and 69, which in turn control the operation of a first, longitude-associated adjusting mechanism 71, a second, latitude-associated adjusting mechanism 72, and a third, altitude-associated adjusting mechanism 73, which constitute the antenna adjusting device 7 and are mechanically coupled to the antenna 2 for re-orienting the antenna 2 toward the target program satellite 3.

The adjusting mechanisms 71, 72, 73 can be any known mechanism for moving the antenna 2, such as that comprising a rotatable table rotated by gear train driven by a servo motor or stepping motor. This is well known and thus no further detail is necessary herein.

Figure 3:
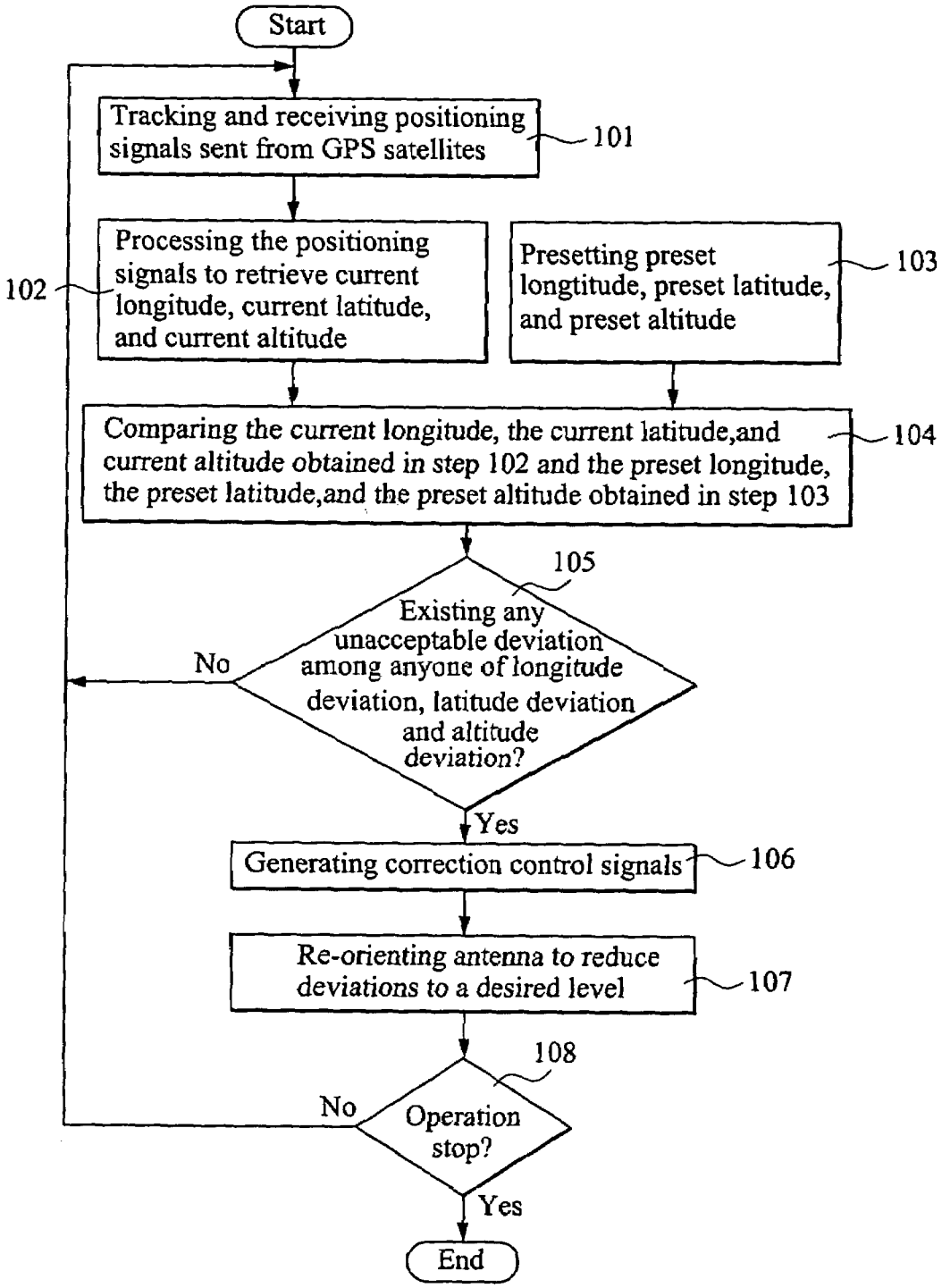
FIG. 3 is a flowchart illustrating orientation adjustment of a satellite antenna carried in a moving vehicle for tracking a satellite.

Also referring to FIG. 3, the operation of the control device in accordance with the present invention will be briefly described. In step 101, the control device of the present invention tracks and receives the positioning signals 32 sent from the GPS satellites 3*a*, 3*b* and 3*c*. The positioning signals 32 are then processed to retrieve the current longitude Sx, the current latitude Sy, and the current altitude Sa (step 102). On the other hand, in step 103, the user selects one of a number of preset program channels or simply sets a program channel of which the preset longitude Tx, the preset latitude Ty and the preset altitude Ta are retrieved (step 103).

The current longitude Sx, the current latitude Sy and the current altitude Sa obtained in step 102 and the preset longitude Tx, the preset latitude Ty, and the preset altitude Ta obtained in step 103 are compared with each other (step 104). In step 105, it is determined if any unacceptable deviation, i.e., any unacceptable deviation among anyone of the longitude deviation Ex, the latitude deviation Ey and the altitude deviation Ea, exists between the current coordinate and the preset coordinate. A negative answer of the judgment step 105 indicates that the antenna 2 is currently in correct orientation and no adjustment or re-orientation is necessary. The process goes back to step 101 again to start a new cycle for continuous and dynamic control of the orientation of the antenna in order to ensure the antenna 2 is always in the correct orientation.

On the other hand, if the answer of the judgment step 105 is positive, then in step 106, the longitude correction control signal Cx, the latitude correction control signal Cy and the altitude correction control signal Ca are generated and applied to the drive circuits 67, 68 and 69 respectively, which in step 107 control the adjusting mechanisms 71, 72, 73 to re-orient the antenna 2 in order to reduce the longitude deviation Ex, latitude deviation Ey and altitude deviation Ea to a desired level, such as approximately zero. In step 108, it is determined if an operation stop instruction is received from for example a user. If positive, then the process stops, otherwise the process goes back to step 101 to start a new cycle of adjustment.

The present invention allows a satellite disc antenna carried in a moving vehicle to make adjustment of the orientation of the antenna with respect to a selected commercial program satellite in order to obtain optimum reception of the program signals transmitted from the commercial program satellite. Thus, program quality shown in a play device can be maintained excellent regardless the moving of the vehicle. Apparently, the present invention can be of a great application in for example satellite program reception in fore example a long distance bus, a passenger marine vehicle and personal amusement.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A device for orienting a satellite antenna carried in a movable carrier by detecting a current coordinate of the movable carrier in accordance with a series of positioning signals received from a group of GPS satellites, the satellite antenna being arranged to orient a selected program satellite to receive a program signal sent from the program satellite, comprising:

a satellite tracking system comprising:

a GPS position receiver that receives the current coordinate of the movable carrier with respect to the program satellite;

a register that stores the preset coordinate of the program satellite;

a GPS position comparator that compares the current coordinate of the movable carrier with the preset coordinate of the program satellite to generate a deviation signal; and a microprocessor that receives the deviation signal and correspondingly issues a correction control signal; and an antenna adjusting device adapted to mechanically and operatively couple to the satellite antenna, comprising an adjusting mechanism that receives the correction control signal and operates in accordance with the correction control signal to orient the satellite antenna.

2. The device as claimed in claim 1, wherein the preset coordinate of the program satellite comprises a preset longitude, a preset latitude, and a preset altitude.

3. The device as claimed in claim 1, wherein the current coordinate of the movable carrier comprises a current longitude, a current latitude, and a current altitude.

4. The device as claimed in claim 1, wherein the satellite tracking system further comprises a channel setting/selection unit adapted to be used by a user to set/select at least one program channel.

5. The device as claimed in claim 4, wherein the satellite tracking system further comprises a memory containing data of at least one program channel adapted to be selected by the user.

6. The device as claimed in claim 5, wherein the memory comprises a section adapted to store a program channel set by the user with the channel setting/selection unit.

7. The device as claimed in claim 1, wherein the deviation signal generated by the comparator comprises a longitude deviation, a latitude deviation, and an altitude deviation.

8. The device as claimed in claim 1, wherein the correction control signal comprises a longitude-associated correction control signal, a latitude-associated correction control signal, and an altitude-associated correction control signal.

9. A method for orienting a satellite antenna installed in a movable carrier, operated with a satellite signal processing system comprising a plurality of GPS satellites and at least one program satellite, the method comprising steps of:

(a) tracking and receiving a series of positioning signals sent from the GPS satellites;

(b) processing the positioning signals to retrieve at least one current coordinate of the movable carrier with respect to the program satellite;

(c) comparing the current coordinate with a preset coordinate of the program satellite;

(d) comparing the current coordinate of the movable carrier with the preset coordinate of the program satellite to generate at least one deviation signal;

(e) receiving the deviation signal and correspondingly generating at least one correction control signal; and (f) re-orienting the satellite antenna in correspondence to the correction control signal.

10. The method as claimed in claim 9, wherein the preset coordinate of the program satellite comprises a preset longitude, a preset latitude, and a preset altitude.

11. The method as claimed in claim 9, wherein the current coordinate of the movable carrier comprises a current longitude, a current latitude, and a current altitude.

12. The method as claimed in claim 9, wherein the deviation signal comprises a longitude deviation, a latitude deviation, and an altitude deviation.

13. The method as claimed in claim 9, wherein the correction control signal comprises a longitude-associated correction control signal, a latitude-associated correction control signal, and an altitude-associated correction control signal.

* * * * *